US007874844B1

(12) United States Patent
Fitts, Jr.

(10) Patent No.: US 7,874,844 B1
(45) Date of Patent: Jan. 25, 2011

(54) UNIVERSAL MAGNETIC POWER SUPPLY ADAPTOR

(76) Inventor: Darrell Lynn Fitts, Jr., 3900 Dave Ward Dr., PMB 104, Conway, AR (US) 72032

( * ) Notice: Subject to any disclaimer, the term of this patent is extended or adjusted under 35 U.S.C. 154(b) by 0 days.

(21) Appl. No.: 12/698,203

(22) Filed: Feb. 2, 2010

(51) Int. Cl.
*H01R 11/30* (2006.01)

(52) U.S. Cl. ..... 439/39; 439/218; 439/638; 439/675

(58) Field of Classification Search ..... 439/39, 439/218, 638, 675, 217
See application file for complete search history.

(56) References Cited

U.S. PATENT DOCUMENTS

| | | | | |
|---|---|---|---|---|
| 3,810,258 | A * | 5/1974 | Mathauser | 439/39 |
| 5,593,323 | A * | 1/1997 | Dernehl | 439/668 |
| 5,941,729 | A * | 8/1999 | Sri-Jayantha | 439/505 |
| 6,565,363 | B2 * | 5/2003 | Downing | 439/39 |
| 6,607,391 | B2 * | 8/2003 | Mendelson et al. | 439/39 |
| 6,638,076 | B2 * | 10/2003 | Wang | 439/39 |
| 6,904,373 | B2 | 6/2005 | Le et al. | |
| 7,311,526 | B2 | 12/2007 | Rohrbach et al. | |
| 7,351,066 | B2 | 4/2008 | DiFonzo et al. | |
| 7,503,807 | B2 * | 3/2009 | Martin et al. | 439/638 |
| 7,517,222 | B2 | 4/2009 | Rohrbach et al. | |
| 7,607,920 | B1 * | 10/2009 | Chen | 439/39 |
| 2002/0160629 | A1 * | 10/2002 | Lau et al. | 439/39 |
| 2005/0208783 | A1 | 9/2005 | Suzuki et al. | |
| 2005/0255718 | A1 | 11/2005 | McLeish | |
| 2006/0051981 | A1 | 3/2006 | Neidlein et al. | |
| 2008/0096398 | A1 | 4/2008 | Rohrbach et al. | |
| 2008/0305649 | A1 * | 12/2008 | Didur et al. | 439/39 |
| 2010/0136801 | A1 * | 6/2010 | Limpkin et al. | 439/39 |
| 2010/0144164 | A1 * | 6/2010 | Wang et al. | 439/39 |

* cited by examiner

*Primary Examiner*—Gary F. Paumen
(74) *Attorney, Agent, or Firm*—Molly D. McKay

(57) ABSTRACT

A universal power plug adapter for supplying power to an electrical device. The adaptor is comprised of two intermediate electrical connectors attached together by magnetic force. One connector attaches to an electrical power supply, and another contains a plug compatible with the receptacle on one or more electrically powered devices. An optional specially designed extension cord can be inserted between the two connectors. The extension cord has ends that are identical to the two mating ends of the two connectors so that the extension cord can insert therebetween.

6 Claims, 3 Drawing Sheets

UNIVERSAL MAGNETIC POWER SUPPLY ADAPTOR

BACKGROUND OF THE INVENTION

1. Field of the Invention

The present invention relates to a new type of universal power supply adapter for use with AC and DC power supplies for various electrical devices. The adapter utilizes magnetic force to hold the interchangeable parts of the adapter in place during use. An optional specially designed extension cord can be inserted between the two connectors.

2. Description of the Related Art

To store power and function, most electrical devices require direct access to electrical power from standardized "wall" sockets. These sockets provide alternating current electricity or AC power in standard voltages that vary by country. Power adapters, among other functions not related to this invention, take power from these wall sockets and supply the power to specific receptacles on an electrical device. Power supplies may supply devices with either alternating current (AC) or direct current (DC), and DC power supplies may vary by whether the positive and negative currents are associated with the ring-exterior portion of the connector, or the tip-interior portion of the connector.

Universal power adapters attempt to anticipate the size and shape of a portion of the power receptacles on a number of varying devices. There are several reasons for this. For instance, a consumer with several electrical devices may desire a single source to power all of them. Also, consumers often misplace power supplies, since they are, by definition, separable from their associated devices, and then the consumer needs to find a replacement. A power supply with a universal adapter is more marketable to consumers than a single sized power supply because it is compatible with a greater number of devices.

One essential aspect of a universal power supply is that it is able to connect to the varying receptacles of electrical devices. To accomplish this some universal supplies permanently mount a set of plugs on the supply in a manner so any of them can be used. This approach limits the number of receptacles with which the supply can connect at its time of manufacture. Other universal adapters utilize interchangeable plugs, and therefore may connect with any device with which a compatible plug is manufactured. These interchangeable plugs possess a uniform connector that allows all of them to connect to the power supply, but each plug contains a unique size and shape for connecting to the receptacles of varying electrical devices.

Of these universal power supplies with interchangeable plugs, most utilize mechanical force to temporarily connect each of the interchangeable plugs to the power supply. The present invention replaces these traditional mechanical forces, such as friction and various latching mechanisms, with magnetic force to make the connection. This application defines magnetic force as force generated by a permanent or other type of magnet.

Some power supplies, such as those present on some devices manufactured by Apple® Computers utilize permanent magnets to connect a proprietary power supply to a specific intended device. A search of the internet reveals some PC users, envious of Apple's magnetic connection, have modified their PCs' power receptacles and cords with magnets, essentially duplicating Apple's proprietary structure. Neither of these power solutions acts as universal power adapters or works with devices from other manufacturers.

The present invention seeks to address fundamental problems with current power supplies and universal power plug assemblies. First, mechanical latches and friction based connections do not possess the ability to safely "break away" when force is applied to the cord of the power adapter. Because they do not safely break away, this may result in damage to an electrical device receptacle and to the device itself.

Second, mechanical latches that utilize friction sometimes require the application of significant force to exchange the interchangeable parts, thus wearing out the interchange assembly on the power supply over time.

Third, normal use of most power supplies, universal or otherwise, involves the frequent insertion and removal of a power plug into a device receptacle. These device receptacles utilize friction to hold the plug in place and wear out over time due to normal use.

Finally, the interchangeable parts from universal power supplies are subject to being misplaced or lost as they do not automatically stick to any surface. The current invention solves all of these problems.

SUMMARY OF THE INVENTION

The present invention is a power plug adapter comprised of two intermediate electrical connectors attached together by magnetic force. One of the connectors i.e. and input connector, is attached, permanently or otherwise, to an electrical power supply, and the other connector, i.e. the output connector, which contains a plug compatible with the receptacle on one or more electrically powered devices.

The input connector which attaches to an electrical power supply is provided on a first end with two separate electrically conductive surfaces, and sufficient insulation there between to prevent the two from making contact with each other and shorting out. The surfaces may receive electrical current through wires or through contact with the electrically conductive surfaces of another power supply. The electrical surfaces on the first end are connected to two separate electrically conductive contacts on an opposite second end of the connector that are intended to be connected by magnetic force to two conductive contacts on the output connector.

The output connector which is intended to make contact with the receptacle on an electrical device has two ends. The first end of the connector has two electrical contacts that magnetically attach and electrically connect with the conductive contacts on the second end of the input connector. A second end has two conductive surfaces, possibly a traditional ring surface and a tip surface, to connect with the receptacle on the electrical device. Each contact on the second end of the output connector is electrically connected to an associated conductive surface from its opposite first end. The end with the contacts is intended to be connected to the aforementioned connector (to the power supply) by magnetic force. The output connector is inserted into an electrically powered device.

Either of the connectors may utilize a sleeve, lip, or other means of aligning the contacts on the end of the connectors that are connectible through magnetic force.

An optional specially designed extension cord can be inserted between the two connectors. The extension cord has ends that are identical to the two mating ends of the two connectors so that the extension cord can insert therebetween.

DETAILED DESCRIPTION OF THE PREFERRED EMBODIMENT

Figure 1:
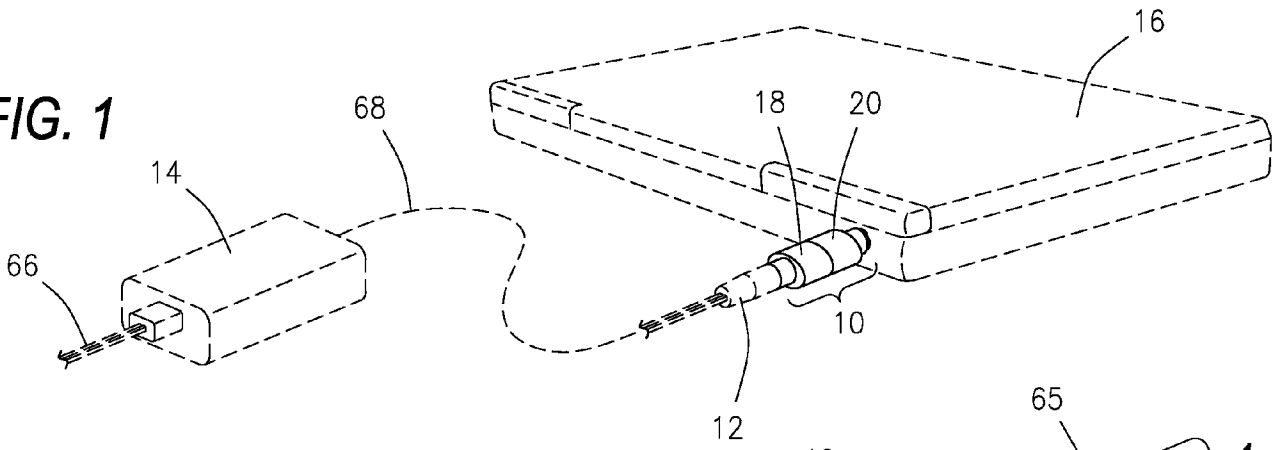
FIG. 1 is a perspective view of an assembled power supply adapter in use between a power supply and an electrical device.

Referring now to the drawings, and initially to FIG. 1, there is illustrated an electrical power adapter 10 constructed in accordance with a preferred embodiment of the present invention. In FIG. 1, a power supply connector 12 that is attached to a power supply 14 is shown inserted into the adaptor 10, and the adapter 10 is connected to an electrical device 16 to supply electrical power to the device 16.

Figure 2:
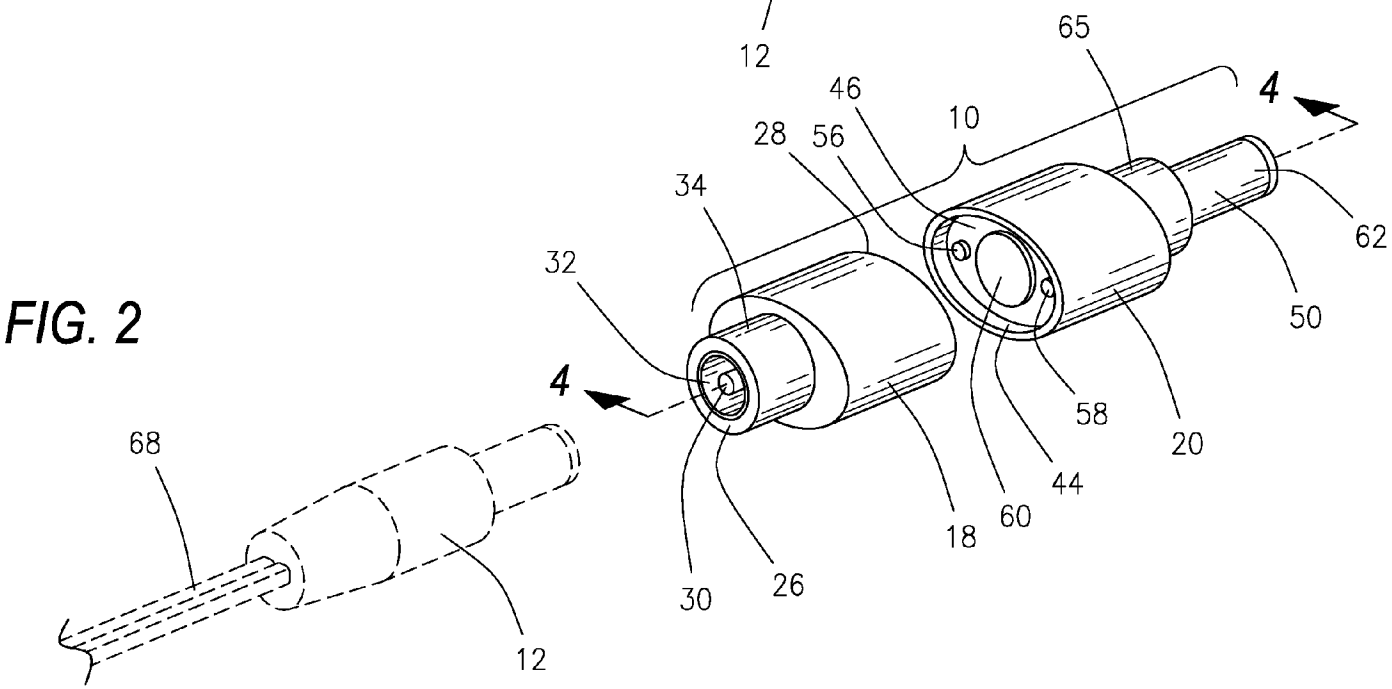
FIG. 2 is an exploded view of the two connectors comprising the adapter of FIG. 1.

Referring now to FIG. 2, the power adapter 10 is comprised of an input power connector 18 and an output power connector 20. The input power connector 18 and the output power connector 20 are removably connected together by magnetic force, as will be explained more fully hereafter.

Figure 3:
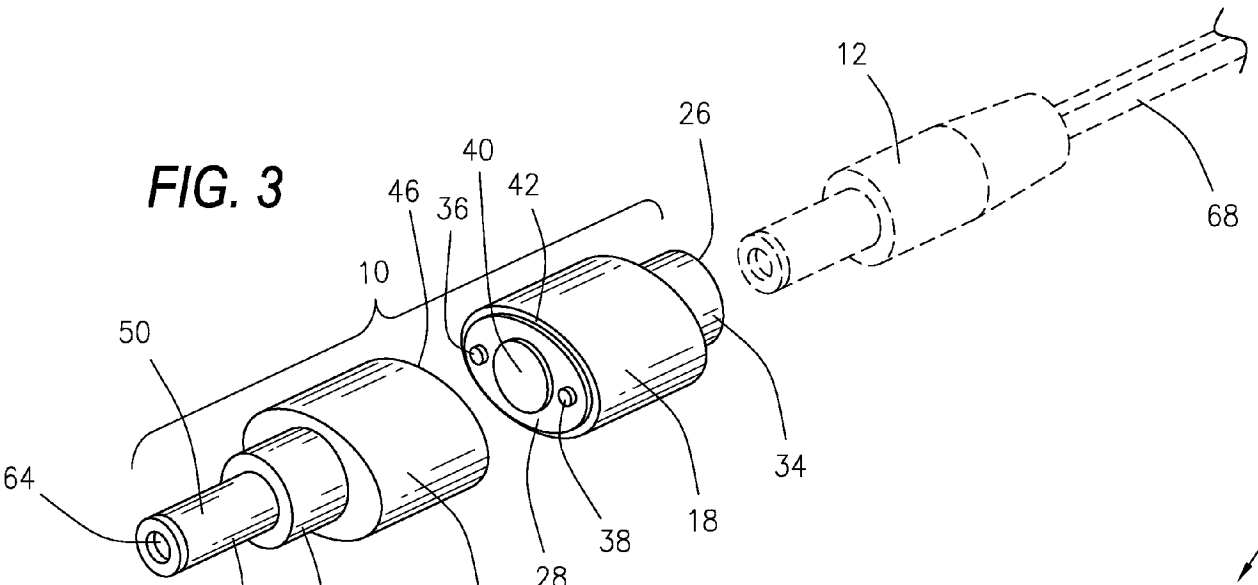
FIG. 3 is the adaptor of FIG. 2 rotated 180 degrees as to show the contacts on the power supply side of the connector.
Figure 4:
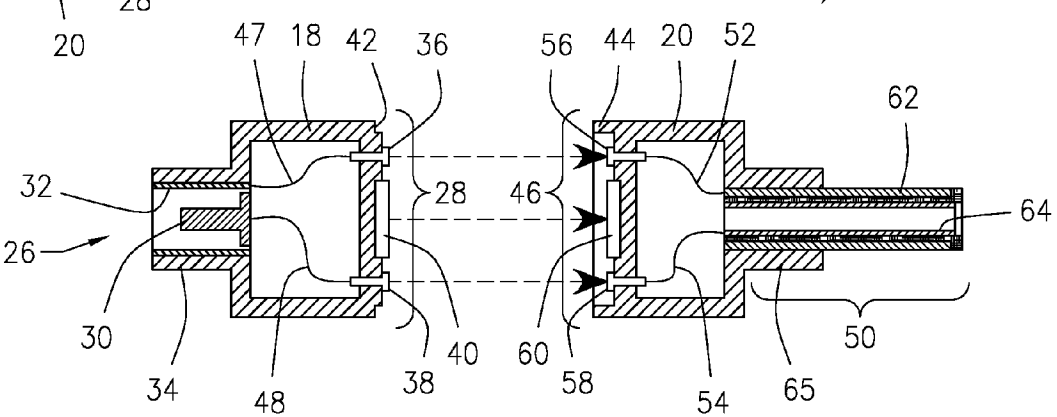
FIG. 4 is a cross sectional view taken along line 4-4 of FIG. 2.

Referring now to FIGS. 2, 3 and 4, the input power connector 18 has a power input receptacle 26 on one end and a magnetic power output plug 28 on the other end. The power input receptacle 26 is comprised of a tip contact point 30 for the tip surface of an external power supply, a ring contact point 32 for a ring surface of an external power supply, and a cylindrical housing 34 containing the two contact points 30 and 32.

The magnetic power output plug 28 is comprised of a ring contact 36, a tip contact 38, a source of magnetic force 40 such as a magnet, and a rim 42 for receiving a mating lip 44 of a magnetic power input socket 46 provided on a first end of the output power connector 20. A wire or other electrical conductive means 47 electrically connects contact point 32 with ring contact 36. Another wire or electrical conductive means 48 electrically connects the contact point 30 with the tip contact 38.

Continuing to refer to FIGS. 2, 3, and 4, the power output connector 20 is comprised of a magnetic power input receptacle or socket 46 on one end, an opposite output end 50, and electrical means 52, 54 connecting the positive and negative electrical currents between the two ends. The magnetic power input socket 46 contains a ring contact 56, a tip contact 58, a source of magnetic force 60, and a lip 44 for receiving the rim 42 of the magnetic power output plug 28. The output end 50 is comprised of external contact ring 62, the contact point for tip connection 64, and a cylindrical housing 65 for the two contacts 62 and 64. Electrical conductor means 54 electrically connects tip contact 58 with contact 64. Electrical conductor means 52 electrically connects ring contact 56 with external ring contact 62.

Referring now to FIGS. 1 and 4, the adapter 10 is assembled when the magnetic output plug 28 of the input power connector 18 is properly inserted into the magnetic input socket 46 of the output power connector 20. When assembled, contact point 36 will be physically and electrically connected to ring contact 56, or alternately, connected to tip contact 58. Also contact point 38 will be physically and electrically connected to whichever contact, either 58 or 56, is not connected to contact 36. It should be noted that connectors 18 or 20 may be rotated 180 degrees relative to each other so as to reverse the electrical polarity associated with the ring connector 62 and tip connector 64. Thus, when the adaptor 10 is assembled and in use, an electrical connection is provided between contact 32 and contact 62 or 64, depending on the relative orientation between 18 and 20, also an electrical connection is provided between contact 30 and contact 64 or 62.

As indicated above, this adaptor 10 has several advantages. First, the magnetic connection between connectors 18 and 20 will be broken when sufficient force is applied to the device 16 or the power supply connector 12, thereby avoiding damage to both the device 16 and the power supply connector 12. The power cord receptacles of laptop computers and other similar devices 16 that use external power supplies 14 are particularly susceptible to damage from power supply cords 66 or 68 being pulled or tripped over.

Second, by leaving the output power connector 20 connected to a device 16, the power supply 14 can be connected to the device 16 without inserting and removing a power adapter from the device 16. Repeated insertion and removal of a connector with the device's power receptacle wears out the receptacle over time. Leaving the output power connector 20 inserted in the device 16 shifts the onus of wear from the receptacle of the device 16 to the magnetic ends 28 and 46 of the input power connector 18 and the output power connector 20. This is desirable because the input power connector 18 and the output power connector 20 are more easily replaced than a power receptacle of an electrical device 16, which in the case of some devices, like laptop computers, requires the replacing of an entire circuit board.

Third, the magnetic connection at 28 and 46 between the input power connector 18 and the output power connector 20 permits greater ease of assembly than current universal power supplies with exchangeable tips utilizing friction and latching do.

Fourth, the input power connector 18 and the output power connector 20, if utilizing permanent magnets as the source of magnetic force 60 and 40, provide users greater ability to effectively organize and store them when not in use, since they will be attracted to any ferromagnetic surface.

Figure 5:
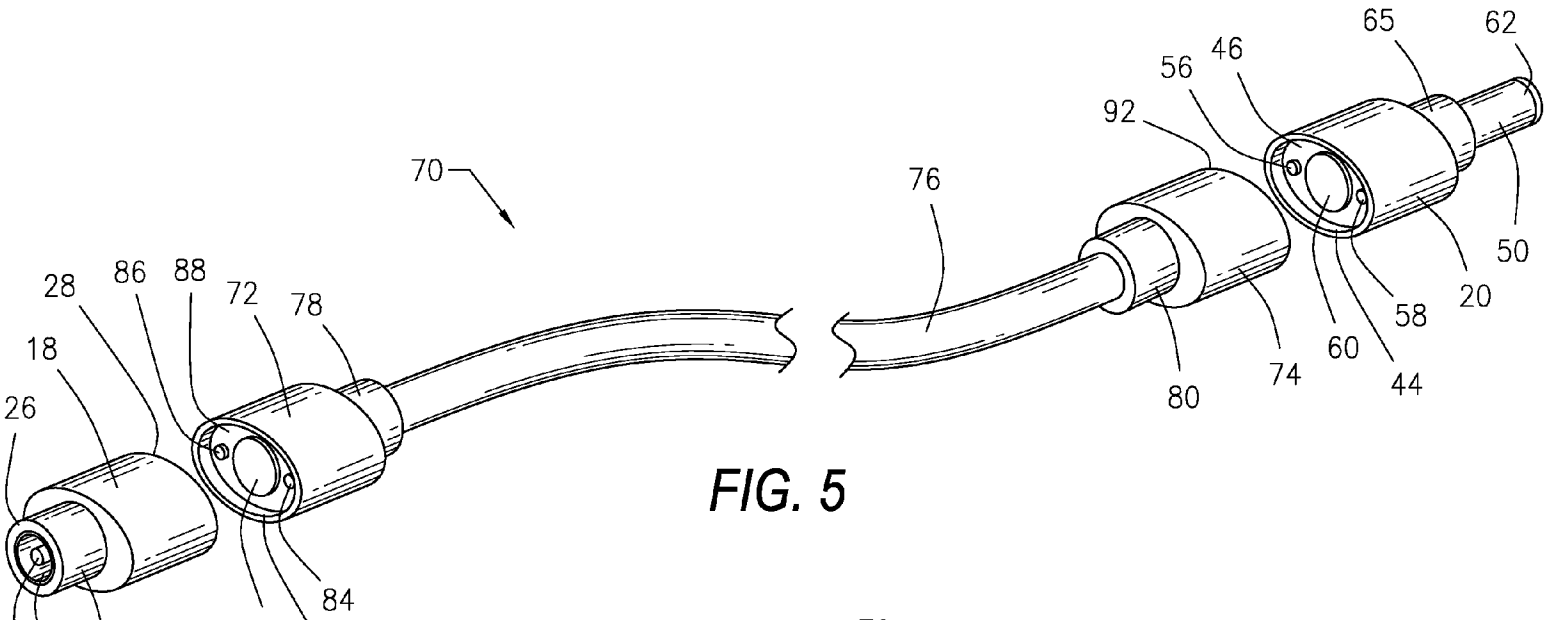
FIG. 5 is a view of the adaptor of FIG. 2 shown in use with an optional specially designed extension cord shown in partial cut away that is inserted between the two connectors.
Figure 6:
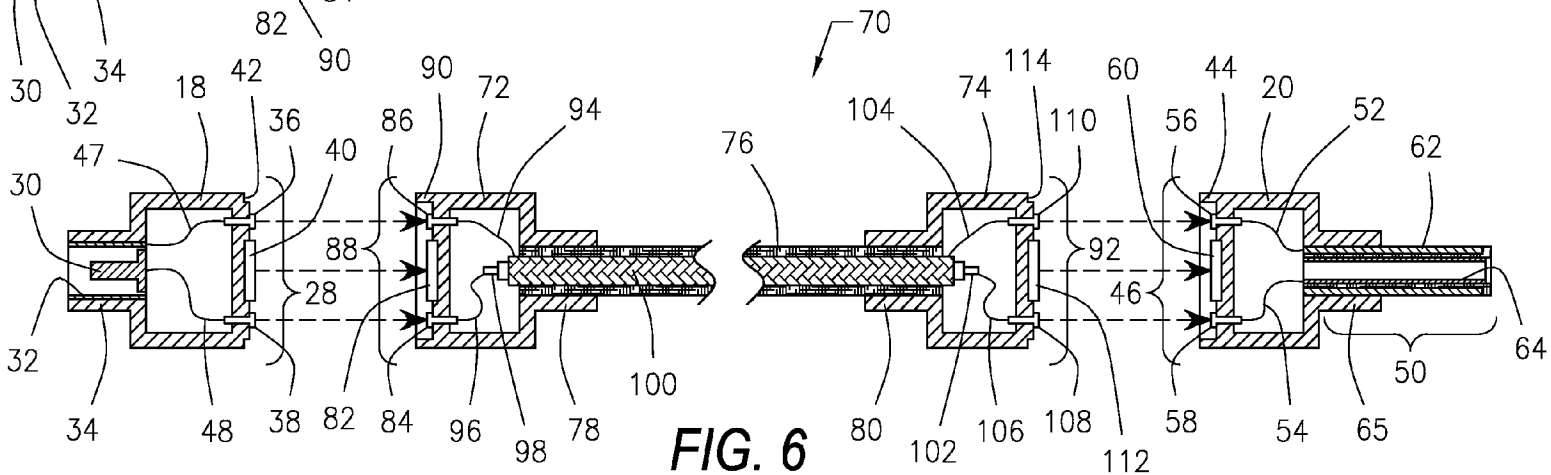
FIG. 6 is a partially cut away, cross sectional view of the adaptor and extension cord of FIG. 5.

Referring now to FIGS. 5 and 6, there is shown an optional specially designed extension cord 70 can be inserted between the input power connector 18 and the output power connector 20. The extension cord 70 has two ends 72 and 74 that have power socket and plug 88 and 92, respectively, that are essentially identical to the two power socket and plug 46 and 28, respectively, provided on the two connectors 18 and 20 so that the extension cord 70 can insert between the two connectors 18 and 20, as shown in the drawings. The exterior of a flexible portion of the extension cord 70 is provided with an insulating cover 76 that extends between the ends 72 and 74. Within the insulating cover 76, the extension cord is provided with a cylindrical conductor 100 that is encircles and is electrically separated by insulation from a central conductor that has two electrically connected ends 98 and 102.

Referring to FIG. 6, the power socket 88 will be compared to the power input socket 46. The power socket 88 is provided with mating lip 90 that is equivalent to mating lip 44, with a tip contact 84 that is equivalent to tip contact 58, with a ring contact 86 that is equivalent to ring contact 56, and with source of magnetic force 82 that is equivalent to source of magnetic force 60. Also, the first end 72 has a cylindrical housing 78 which is equivalent to cylindrical housing 65 on output power connector 20.

Continuing to refer to FIG. 6, the power plug 92 will be compared to the power output plug 28. The power plug 92 is provided with rim 114 that is equivalent to rim 42, with a tip contact 108 that is equivalent to tip contact 38, with a ring contact 110 that is equivalent to ring contact 36, and with source of magnetic force 112 that is equivalent to source of magnetic force 40. Also, the second end 74 has a cylindrical housing 80 which is equivalent to cylindrical housing 34 on input power connector 18.

As illustrated, wire 94 connects ring contact 86 with cylindrical conductor 100, and wire 104 connects cylindrical conductor 100 with ring contact 110. Also, wire 96 connects tip contact 84 with a first end 98 of a central conductor and wire 106 connects a second end 102 of the central conductor with tip contact 108.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. An electrical power adapter comprising:

an input connector and an output connector, each connecter provided with two ends, one end of said input connector connectable to an electrical power source, an opposite end of said input connecter connectable in mating fashion to an end of said output connector, an opposite end of said output connector connectable to an electrically powered device, said input connector and said output connector connected in mating fashion using magnetic force, and electrically conductive contacts and circuits provided on each connector so that electricity flows through the connectors from the electrical power source to the electrically powered device, wherein the end of the input connector intended to be connected to the electrical power source is a receptacle for a traditional "ring and tip" power supply connection.

2. An electrical power adapter comprising:

an input connector and an output connector, each connecter provided with two ends, one end of said input connector connectable to an electrical power source, an opposite end of said input connecter connectable in mating fashion to an end of said output connector, an opposite end of said output connector connectable to an electrically powered device, said input connector and said output connector connected in mating fashion using magnetic force, and electrically conductive contacts and circuits provided on each connector so that electricity flows through the connectors from the electrical power source to the electrically powered device, wherein the end of the output connector that is connectable to an electrically powered device is a male plug for a traditional "ring and tip" power receptacle.

3. An electrical power adapter comprising:

an input connector and an output connector, each connecter provided with two ends, one end of said input connector connectable to an electrical power source, an opposite end of said input connecter connectable in mating fashion to an end of said output connector, an opposite end of said output connector connectable to an electrically powered device, said input connector and said output connector connected in mating fashion using magnetic force, electrically conductive contacts and circuits provided on each connector so that electricity flows through the connectors from the electrical power source to the electrically powered device, and an extension cord insertable between the input connector and an output connector for transmitting electrical power between the two connectors.

4. An electrical power adapter comprising:

an input connector with one side connectable to an electrical power source and a output connector with once side connectable to an electrically powered device wherein the two connectors are mated at compatible opposite ends using magnetic force so that electricity flows between the connectors at designated points of contact in such a manner as to power the electrically powered device through the electrical power source, wherein the end of the connector intended to be connected to an electrical power source is a receptacle for a traditional "ring and tip" power supply connection.

5. An electrical power adapter comprising:

an input connector with one side connectable to an electrical power source and a output connector with once side connectable to an electrically powered device wherein the two connectors are mated at compatible opposite ends using magnetic force so that electricity flows between the connectors at designated points of contact in such a manner as to power the electrically powered device through the electrical power source, wherein the end of the connector that is connectable to an electrically powered device is a male plug for a traditional "ring and tip" power receptacle.

6. An electrical power adapter comprising:

an input connector with one side connectable to an electrical power source and a output connector with once side connectable to an electrically powered device wherein the two connectors are mated at compatible opposite ends using magnetic force so that electricity flows between the connectors at designated points of contact in such a manner as to power the electrically powered device through the electrical power source, and an extension cord insertable between the input connector and an output connector for transmitting electrical power between the two connectors.

* * * * *